US009751187B2

(12) United States Patent
Beckman et al.

(10) Patent No.: US 9,751,187 B2
(45) Date of Patent: Sep. 5, 2017

(54) SYSTEMS AND METHODS FOR FINISHING FLOW ELEMENTS

(71) Applicant: United Technologies Corporation, Hartford, CT (US)

(72) Inventors: Micah Beckman, Middletown, CT (US); Osamuyimen A. Oyegun, Middletown, CT (US)

(73) Assignee: UNITED TECHNOLOGIES CORPORATION, Hartfort, CT (US)

( * ) Notice: Subject to any disclaimer, the term of this patent is extended or adjusted under 35 U.S.C. 154(b) by 0 days.

(21) Appl. No.: 15/048,562

(22) Filed: Feb. 19, 2016

(65) Prior Publication Data

US 2016/0167190 A1 Jun. 16, 2016

Related U.S. Application Data

(63) Continuation of application No. PCT/US2014/061336, filed on Oct. 20, 2014.

(60) Provisional application No. 61/896,971, filed on Oct. 29, 2013.

(51) Int. Cl.

| | |
|---|---|
| ***B24B 31/10*** | (2006.01) |
| ***B24B 31/116*** | (2006.01) |
| ***C21D 7/06*** | (2006.01) |
| ***B24B 19/14*** | (2006.01) |
| ***B24B 1/04*** | (2006.01) |
| ***B24C 3/32*** | (2006.01) |

(52) U.S. Cl.

CPC ..... *B24B 31/116* (2013.01); *B24B 1/04* (2013.01); *B24B 19/14* (2013.01); *B24C 3/32* (2013.01); *C21D 7/06* (2013.01)

(58) Field of Classification Search

CPC ..... B24B 31/116; B24B 1/04; B24B 19/04
USPC ..... 451/36, 37
See application file for complete search history.

(56) References Cited

U.S. PATENT DOCUMENTS

| | | | | |
|---|---|---|---|---|
| 6,957,511 | B1 * | 10/2005 | Leigh | B23H 5/08 451/36 |
| 8,062,094 | B2 * | 11/2011 | Cisek | B23P 9/00 451/33 |
| 2001/0022705 | A1 * | 9/2001 | Mori | C03B 32/02 360/135 |
| 2002/0014208 | A1 | 2/2002 | Roberts et al. | |
| 2002/0042978 | A1 * | 4/2002 | Cheppe | B24B 1/04 29/90.7 |

(Continued)

FOREIGN PATENT DOCUMENTS

| | | | |
|---|---|---|---|
| EP | 1813686 A1 * | 8/2007 | B23P 9/00 |
| WO | 9509714 | 4/1995 | |

OTHER PUBLICATIONS

International Preliminary Report on Patentability dated May 3, 2016 in Application No. PCT/US2014/061336.

(Continued)

*Primary Examiner* — George Nguyen
(74) *Attorney, Agent, or Firm* — Snell & Wilmer L.L.P.

(57) ABSTRACT

Systems and methods for finish portions of parts for gas turbine engines are provided. More specifically, systems and methods for finishing flow elements (e.g., stator vanes and turbine blades) or gas turbine engines are provided. The systems and methods may employ grit blasting, fluidic machining, and/or super polishing. Moreover, the flow elements may be inspected and/or evaluated between the one or more processing steps.

17 Claims, 11 Drawing Sheets

(56) References Cited

U.S. PATENT DOCUMENTS

| | | | | |
|---|---|---|---|---|
| 2003/0083000 | A1* | 5/2003 | Sambuco, Jr. ..... | B24B 1/00 451/49 |
| 2007/0107807 | A1 | 5/2007 | Vigneau | |
| 2007/0137034 | A1 | 6/2007 | Guemmer et al. | |
| 2007/0175030 | A1 | 8/2007 | Luna et al. | |
| 2007/0234564 | A1 | 10/2007 | Shafir | |
| 2011/0047777 | A1 | 3/2011 | Soucy et al. | |
| 2011/0192205 | A1 | 8/2011 | Ganesh | |

OTHER PUBLICATIONS

International Search Report and Written Opinion dated Feb. 4, 2015 in Application No. PCT/US2014/061336.

* cited by examiner

SYSTEMS AND METHODS FOR FINISHING FLOW ELEMENTS

CROSS-REFERENCE TO RELATED APPLICATIONS

This application is a continuation of, claims priority to and the benefit of, PCT/US2014/061336 filed on Oct. 20, 2014 and entitled "SYSTEMS AND METHODS FOR FINISHING FLOW ELEMENTS," which claims priority from U.S. Provisional Application No. 61/896,971 filed on Oct. 29, 2013 and entitled "SYSTEMS AND METHODS FOR FINISHING FLOW ELEMENTS." Both of the aforementioned applications are incorporated herein by reference in their entirety.

FIELD OF INVENTION

The present disclosure relates to systems and methods for finishing flow elements, and more particularly, to improving the surface finish of flow elements.

BACKGROUND OF THE INVENTION

Operation of gas turbine engines may be improved by reducing turbulent and/or rough surfaces in the flow path of the air used for propulsion. More specifically, improving the surface finish of stator vanes and turbine blades may improve the overall operational efficiency of the gas turbine engine. Moreover, reducing the need to hand finish elements that encounter airflow during operation may improve the overall manufacturing efficiency of a gas turbine engine.

SUMMARY OF THE INVENTION

A method for finishing a surface of a part is provided. The method may comprise fluidic machining at least a portion of a flow element to obtain a surface roughness of no more than 20 $R_A$. The flow element may be inspected after and/or in response to the fluidic machining. The method may further comprise super polishing the portion of the flow element to obtain a surface roughness of no more than 10 $R_A$.

A method for improving the surface finish of a part is provided. The method may comprise subjecting a first part and a second part to a grit blast operation. The first part may comprise a first plurality of flow elements. The second part may comprise a second plurality of flow elements. The method may further comprise subjecting the first part and the second part to a fluidic machining operation. The method may also comprise subjecting the first part and the second part to a super polishing process. The surface roughness of the first plurality of flow elements and the second plurality of flow elements may not be greater than 10 $R_A$.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Different cross-hatching and/or surface shading may be used throughout the figures to denote different parts but not necessarily to denote the same or different materials.

In various embodiments, elements and/or structures in the flow path of a gas turbine engine (e.g., stator vanes and turbine blades) may directly affect the efficiency and/or operation of a gas turbine engine. Moreover, the surface finish of the vane may impact the fluid flow through a gas turbine engine. As such, improving the surface finish of the vane is desirable to increase the efficiency and overall performance of a gas turbine engine. As used herein, a vane may comprise any part that is capable of moving a fluid, such as a blade or airfoil.

Figure 1:
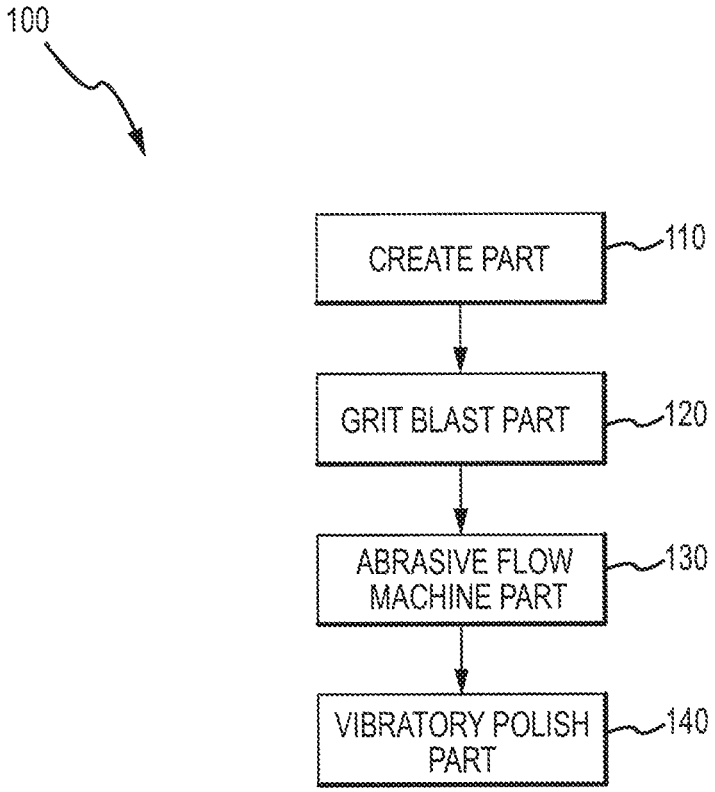
FIG. 1 illustrates a process flow of a finishing process, in accordance with various embodiments
Figure 2:
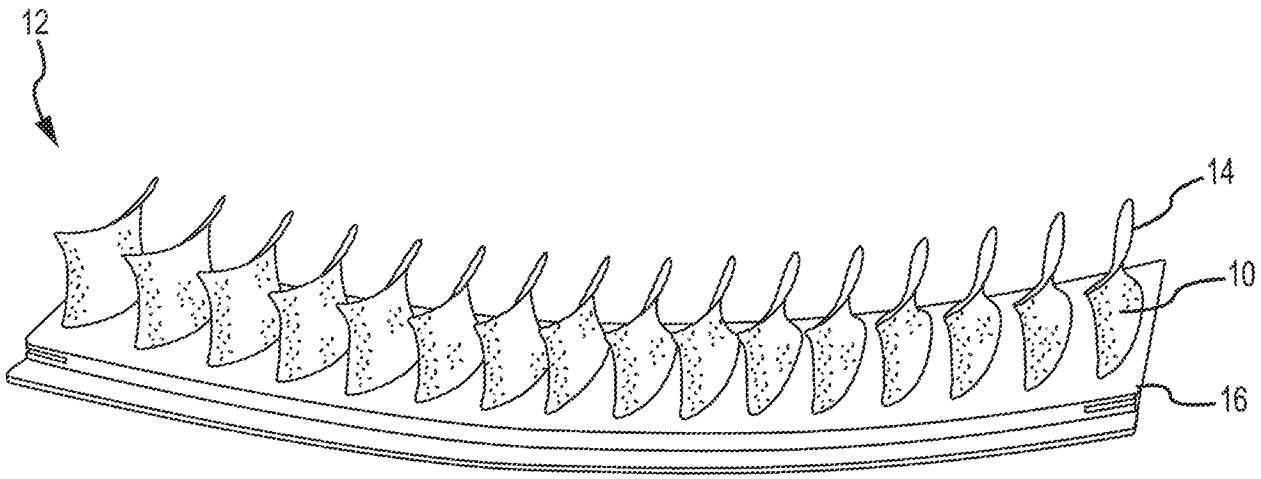
FIG. 2 illustrates a perspective view of a plurality of flow elements after creation of the part, in accordance with various embodiments.
Figure 3:
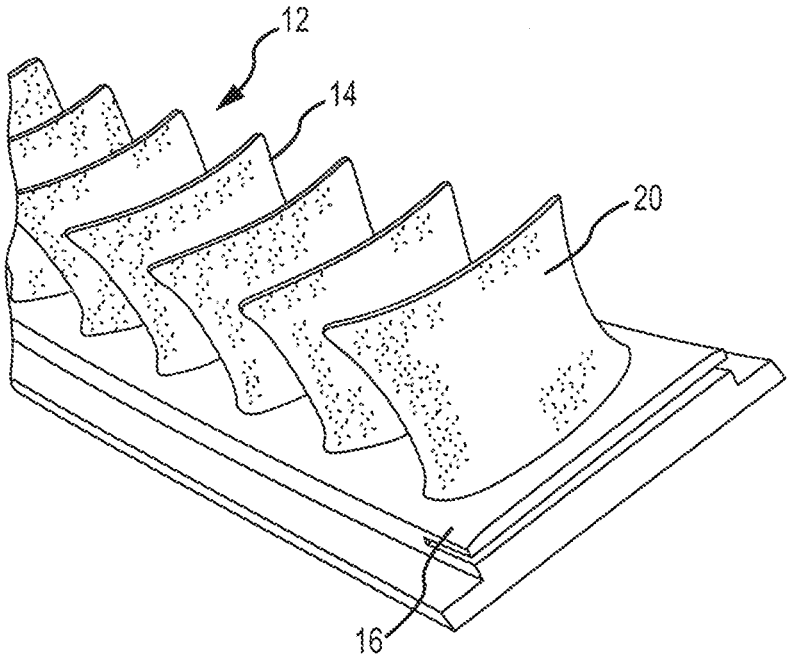
FIG. 3 illustrates a perspective view of a plurality of flow elements subjected to a first step of a finishing process, in accordance with various embodiments.

In various embodiments and with reference to FIGS. 1-3, part 12 may comprise one or more vanes 14 coupled to a body portion 16. Vanes 14 may comprise a surface finish 10. In this regard, when part 12 may be made and/or formed using a rapid prototyping process, vane 14 may have a surface finish 10 having a surface roughness of 200-300 RA. Part 12 may be created by any suitable rapid prototyping process including, for example, selective laser sintering ("SLS"). SLS may use a laser to sinter powder based materials in layers to form a solid model. Various materials may be sintered in a SLS process, including various metals and nylon. Vanes 14 may be formed in particle sintering process (Step 110).

In various embodiments, to improve the performance and/or efficiency of a gas turbine engine, vane 14 may be processed to improve the surface finish 10 of vane 14. For example, as part of method 100, portions of vane 14 may be grit blast (Step 120). The grit blast process may remove un-sintered powder and/or improve the overall smoothness of vane 14 from the surface roughness of surface finish 10 to surface finish 20 having a surface roughness of 150-180 RA. In this regard, the smoothness of surface finish 20 of a portion of the vane that contacts airflow during gas turbine operation may be improved.

Figure 4:
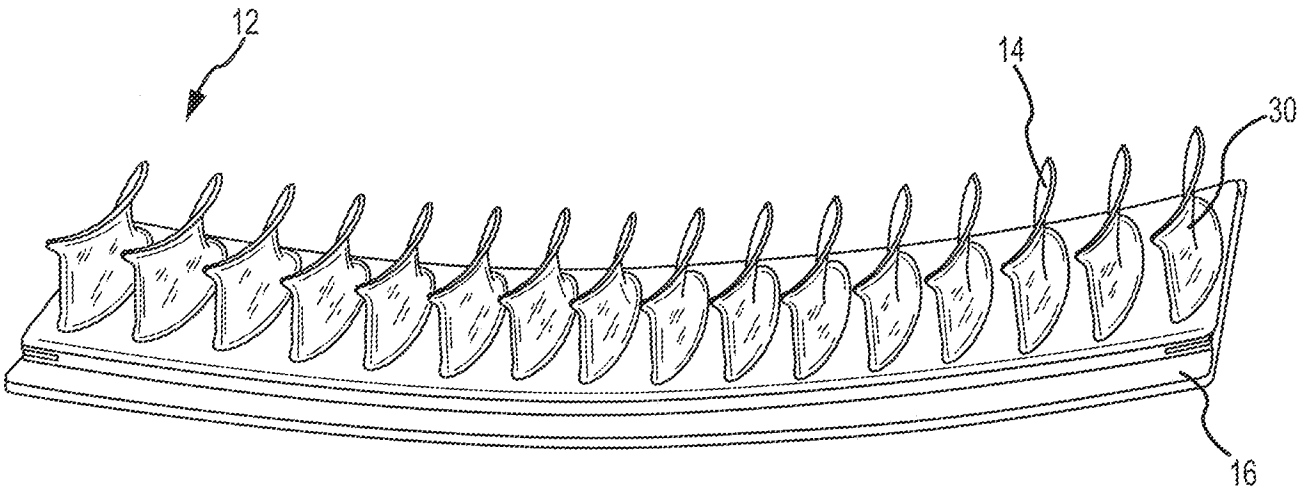
FIG. 4 illustrates a perspective view of a plurality of flow elements subjected to a second step of a finishing process, in accordance with various embodiments.

In various embodiments, and with reference to FIGS. 1 and 4, a surface finish 30 of vane 14 may be further improved by additional surface finish processing. For example, as part of method 100, vane 14 may be subjected to fluidic machining (Step 130) with an abrasive flow media.

The fluidic machining process may shape and/or remove material from portions of part 12 including, for example, vanes 14. In this regard, the fluidic machining process may change the overall geometry, profile, and/or surface finish 30 of vanes 14. Moreover, the fluidic machining process may be utilized and/or configured to process more than one part 12.

In various embodiments, the fluidic machining process may use an abrasive paste comprising a carrier paste and an abrasive element. In this regard, the significant and intended surface material removal from vanes 14 during fluidic machining provides a machined surface finish 30 having a surface roughness of approximately 20 RA. However, this surface finish is not considered a polished surface finish. More specifically, there may be machining lines in the direction of abrasive media flow in vanes 14 as a result of (and/or in response to) the fluidic machining process. In response to the fluidic machining process, part 12 and/or one or more vanes 14 may be evaluated and/or inspected to insure that part 12 and/or one or more vanes 14 confirm with a prescribed dimension, a blueprint drawing, a specification, and/or the like.

Figure 5:
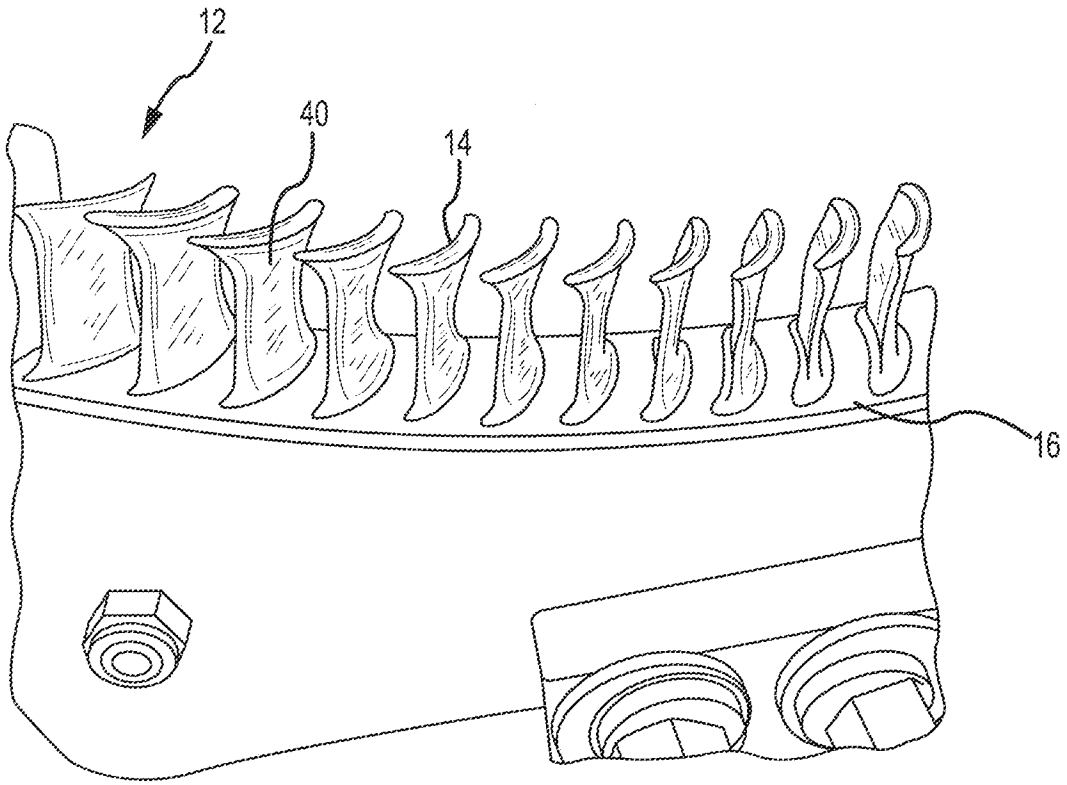
FIG. 5 illustrates a perspective view of a plurality of flow elements subjected to a third step of a finishing process, in accordance with various embodiments.

In various embodiments, and with reference to FIGS. 1 and 5, one or more fluidic-machined parts 12 may be super polished. More specifically, as part of method 100, one or more parts 12 may be vibratory polished (Step 140). The super polished process may employ a super polished media that is loaded and/or coated with abrasive particles. Part 12 may be vibrated within the super polished media. In this regard, one or more parts 12 may be abraded by the abrasive particles. The media may be a non-abrasive ceramic. The abrasive particles may be loaded and/or coated on the non-abrasive ceramic media. The media and particles may be subjected to and/or provided with water. In this regard, the abrasive particles may become a paste that detach from the media and interact with portions of one or more parts 12 to super polish parts 12, and more specifically, to super polish the vanes 14 of the one or more parts 12. Moreover, the super polish process may be configured to provide a surface finish 40 having a surface roughness of less than 10 RA. More specifically, the vibratory super polished process may be configured to provide surface finish 40 having a surface roughness on vane 14 of less than and/or approximately 5 RA.

In various embodiments, the interim surface characteristics of vane 14 are monitored and/or relevant to the success of the entire process. In this regard, the dimensional changes of vane 14 may be tracked from manufacture of initial part 12 through grit blast, fluidic machining, and/or super polishing. The amount of material removed between each processing step, and surface finish 10, 20, 30 and/or 40 of vane 14 as a result of (and/or in response to) each processing step may be designed and controlled to achieve a proper and/or ideal surface finish.

In various embodiments, surface finish 40 and/or the process used to obtain surface finish 40 may be detectable. Moreover, the attributes and/or properties of surface finish 40 may be compared to available processing methods such as, for example, micro machining process (MMP). In this regard, the process described herein may be an alternative to a MMP. Moreover, surface finish 40 is distinguishable from a surface finished provided by a MMP.

Figure 6A:
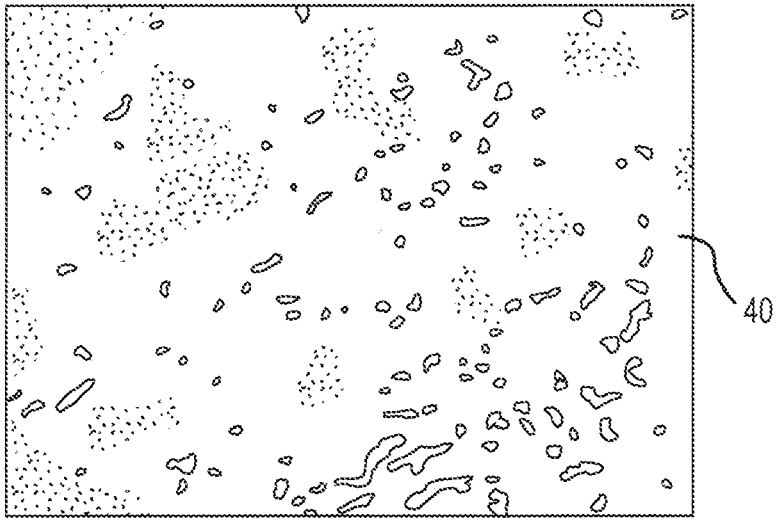
FIG. 6A illustrates a view of a surface subjected to at least a portion of the finishing process illustrated in FIG. 1, in accordance with various embodiments.
Figure 7A:
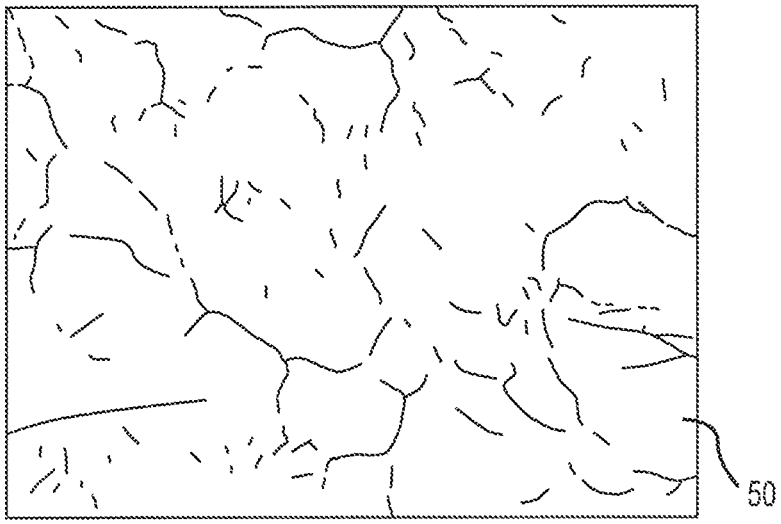
FIG. 7A illustrates a view of a surface subjected to a micro machining process ("MMP")

In various embodiments, FIG. 6A shows a surface finish 40 of a portion of a part that has been subjected to method 100 as described herein. FIG. 7A, shows a surface finish 50 of a portion of a part that has been subjected to MMP. While both finishing by MMP and method 100 may produce parts with similar surface roughness (e.g., less than 10 RA), the parts may exhibit detectably different surface characteristics and/or features. In this regard, the surface characteristics of each of surface finish may be both qualitatively distinguishable and quantitatively distinguishable.

In various embodiments, a visual evaluation or FIGS. 6A and 7A shows that the characteristics of surface finish 40 and surface finish 50 are visually different. In this regard, an operator could compare images of a representative surface finish 40 and surface finish 50 to identify that surface finish 40 may have been produced by method 100 and surface finish 50 may have been produced by MMP. Moreover, where a user is attempting to determine whether a part has been finished by method 100 or MMP, the user may be provided with a picture showing qualitative characteristics (e.g., visual characteristics) of a part with a surface finished produced by method 100 (e.g., FIG. 6A) and a part with a surface finish produced by MMP (e.g., FIG. 7A).

Figure 6B:
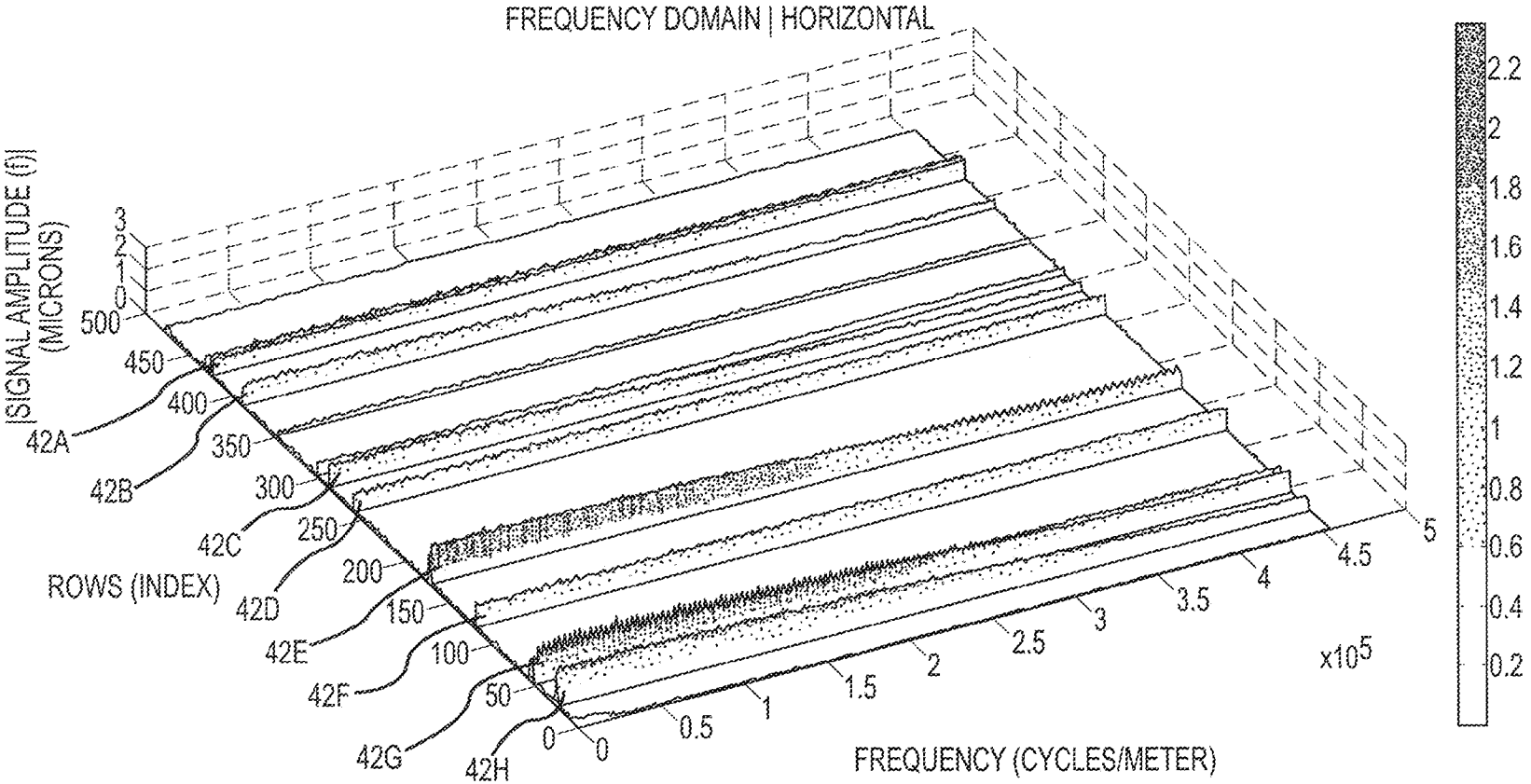
FIG. 6B illustrates a first approximation of the smoothness of a surface subjected to at least a portion of the finishing process illustrated in FIG. 1, in accordance with various embodiments.
Figure 6C:
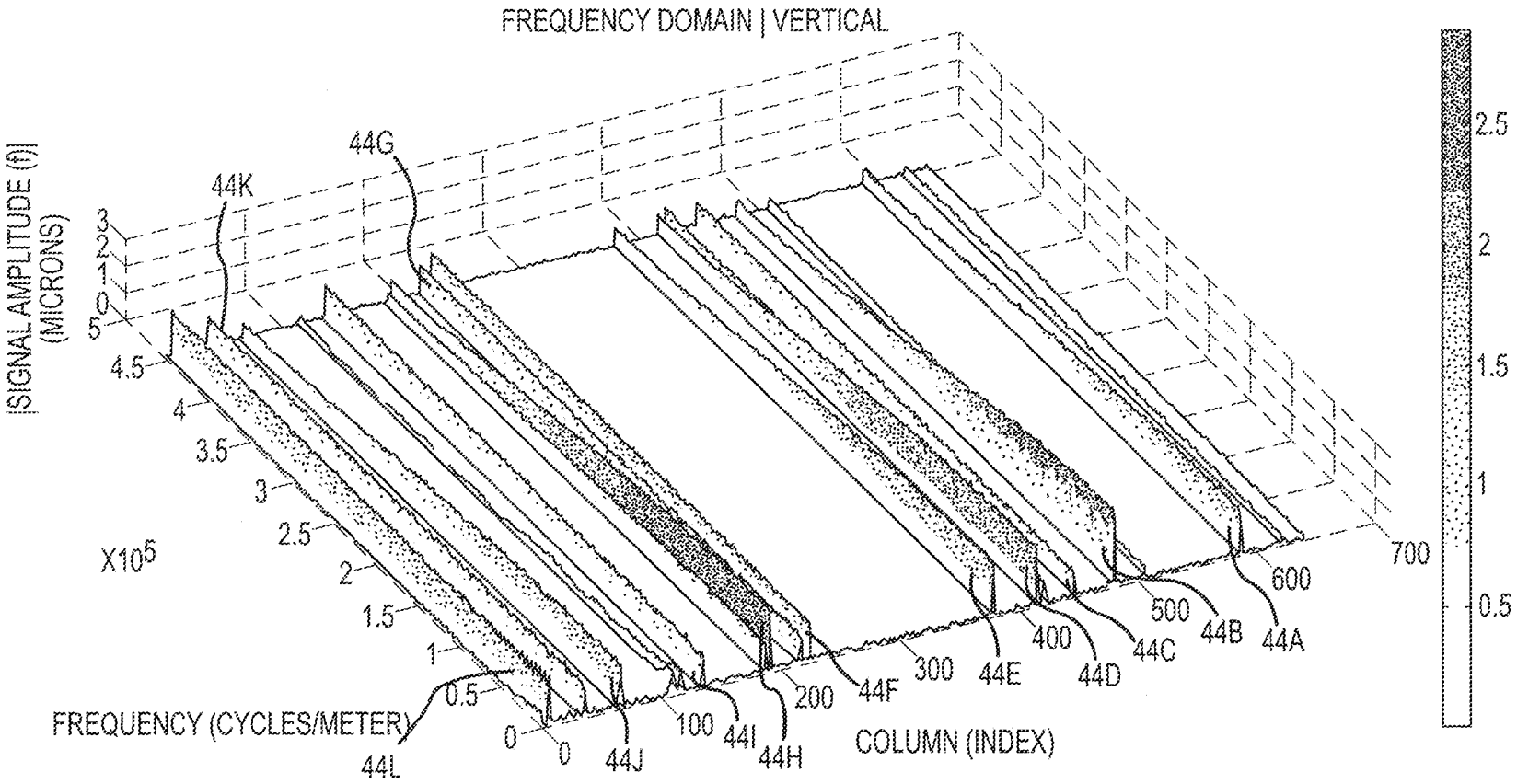
FIG. 6C illustrates a second approximation of the smoothness of a surface subjected to at least a portion of the finishing process illustrated in FIG. 1, in accordance with various embodiments.

In various embodiments, a surface finish of a part may also be evaluated and/or measured to quantitatively determine whether the part has been finished by method 100 or MMP. For example, by evaluating the roughness of the surface with an interferometer, point (x, y, z) data may be obtained for a plurality of points on the surface. Linear Fourier transforms may be used in the abscissa and ordinate coordinate directions to further measure and/or identify expected characteristics in for method 100. Moreover, this analysis may yield the frequency domain of the topological profile of surfaces finish 40. Surface finish 40 may exhibit gouges. The gouges may be approximately linear, but may not be wholly liner. In this regard, surface finish 40 may generally exhibit gouges in the direction of flow during the pressurized abrasive flow media sub process. The gouges may augment the magnitude of all frequencies along the gouge path. In this regard, the gouge may be a deviation from the nominal surface along a path. Thus the magnitude of all signals the along the path of the gouge will further deviate from nominal. In this way, the gouge may be detected as an increase in magnitude in the frequency domain. This augmentation may be detectable when the interferometer data is analyzed and plotted as a frequency domain of the surface. In this regard, indicia of the gouges (e.g., 42A-42H and 44A-44L) are graphically represented, as shown in FIGS. 6B and 6C. In this regard, indicia of the gouges in a first and second direction may be visible in the frequency plot FIGS. 6B and 6C.

Figure 7B:
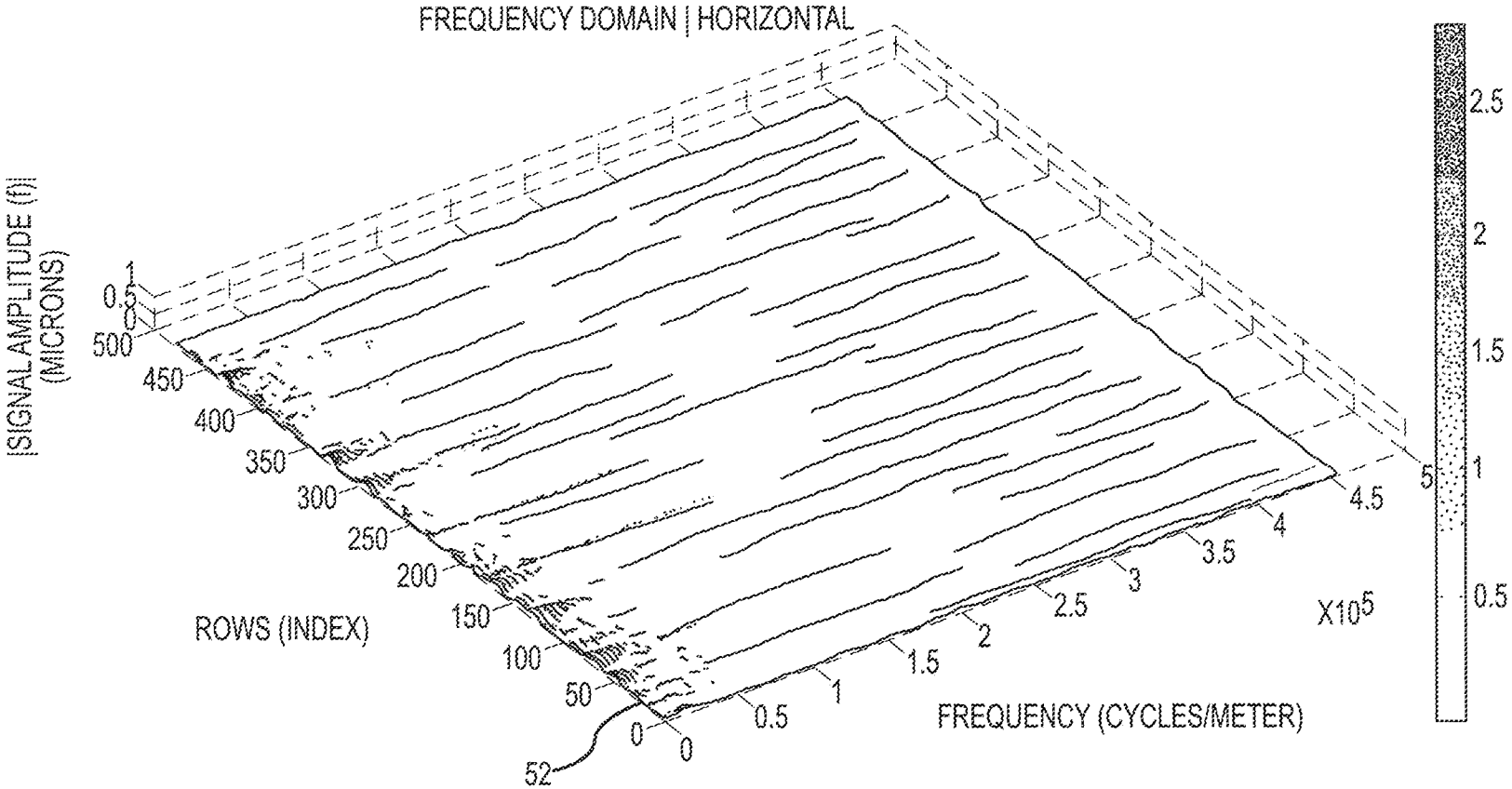
FIG.7B PRIOR ART
FIG. 7B illustrates a first approximation of the smoothness of a surface subjected to the MMP.
Figure 7C:
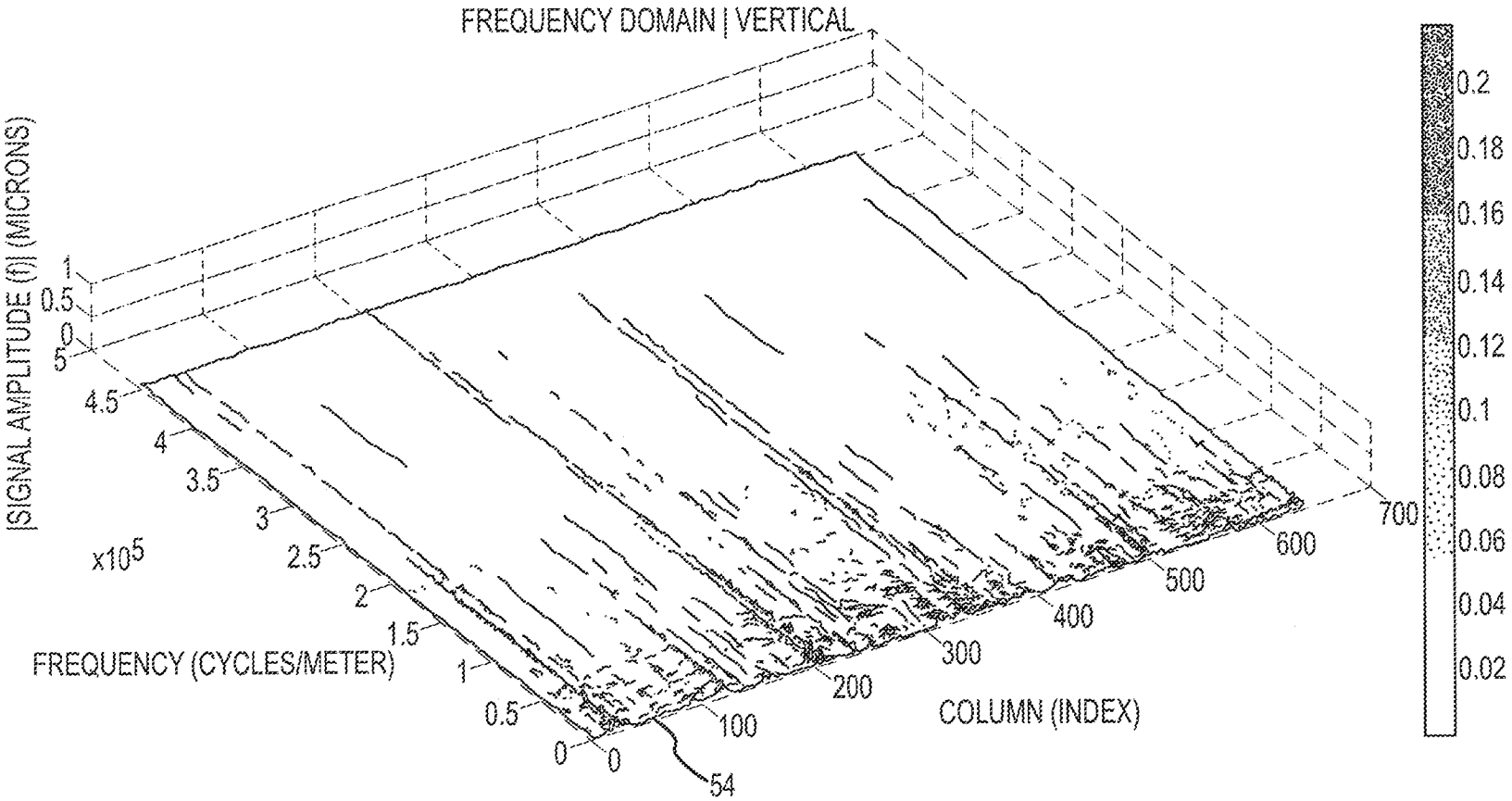
FIG.7C PRIOR ART
FIG. 7C illustrates a second approximation of the smoothness of a surface subjected to the MMP.

By comparison, a similar measurement and analysis of surface 50 processed by MMP so no such indicia of gouges. In this regard, the general trend of the data (e.g., 52 and 54) approximating the surface roughness of surface finish 50 is relatively uniform, as shown in FIGS. 7B and 7C.

In various embodiments, the processes and methods described herein (e.g., method 100), may be used in conjunction with one, two and/or a plurality of parts 12. In this regard, method 100 may be scalable to accommodate a suitable manufacturing volume. Moreover, the various steps of method 100 may be suitable modified and/or implemented with standard and/or custom tooling to insure proper handling and/or processing of one or more parts 12 through the various method steps.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A method comprising:

fluidic machining at least a portion of a flow element to obtain a surface roughness of no more than 20 RA;

inspecting the portion of the flow element; and after fluidic machining, super polishing the portion of the flow element to obtain a surface roughness of no more than 10 RA.

2. The method of claim 1, wherein the fluidic machining employs an abrasive paste.

3. The method of claim 1, wherein the super polishing obtains a surface finish of less than 5 Ra.

4. The method of claim 1, wherein the super polishing process employs a ceramic media loaded with an abrasive particle.

5. The method of claim 4, wherein the super polishing process employs water to create a paste with the abrasive particles.

6. The method of claim 1, wherein the flow element is created by a rapid prototyping process.

7. The method of claim 1, further comprising grit blasting the flow element prior to the fluidic machining.

8. The method of claim 1, wherein the flow element has a surface finish that includes a plurality of gouges.

9. The method of claim 8, wherein the gouges are detectable after the super polishing.

10. The method of claim 9, wherein the gouges are an indication of the fluidic machining.

11. A method, comprising:

subjecting a first part and a second part to a grit blast operation, wherein the first part comprises a first plurality of flow elements and the second part comprises a second plurality of flow elements subjecting the first part and the second part to a fluidic machining operation; and subjecting the first part and the second part to a super polishing process, wherein the surface roughness of the first plurality of flow elements and the second plurality of flow elements is not greater than 10 RA;

wherein the fluidic machining operation introduces detectable gouges in at least one of the first part and the second part.

12. The method of claim 11, further comprising producing the first part from a rapid prototyping process and producing the second part from a rapid prototyping process.

13. The method of claim 11, wherein the first plurality of flow elements and the second plurality of flow elements have a surface roughness of not greater than 20 RA in response to the fluidic machining operation.

14. The method of claim 11, wherein the first plurality of flow elements and the second plurality of flow elements have a surface roughness of not greater than 5 RA in response to the super polishing process.

15. The method of claim 14, wherein a detectable gouge is present in the surface of the first plurality of flow elements and the second plurality of flow elements in response to the super polishing process.

16. The method of claim 11, wherein the plurality of parts are subjected to the grit blast operation, the fluidic machining operation and the super polishing operation.

17. The method of claim 11, wherein fluidic machining operation uses an abrasive paste.

* * * * *